US007272994B1

(12) United States Patent
Johnson

(10) Patent No.: US 7,272,994 B1
(45) Date of Patent: Sep. 25, 2007

(54) BOLT GRASPING DEVICE

(76) Inventor: Jerry L. Johnson, 8916 Pennystone Ave., Las Vegas, NV (US) 88134

( * ) Notice: Subject to any disclaimer, the term of this patent is extended or adjusted under 35 U.S.C. 154(b) by 0 days.

(21) Appl. No.: 11/404,251

(22) Filed: Apr. 14, 2006

(51) Int. Cl.
*B25B 9/00* (2006.01)

(52) U.S. Cl. ..... 81/13; 81/487; 81/349; 81/426.5

(58) Field of Classification Search ..... 81/13, 81/487, 44, 345–350, 383.5, 443, 426.5, 81/91.1, 90.1–90.3, 91.3, 126, 128; 248/316.5; 294/100, 115
See application file for complete search history.

(56) References Cited

U.S. PATENT DOCUMENTS

| | | | | |
|---|---|---|---|---|
| 943,545 | A * | 12/1909 | Holman | 81/90.2 |
| 2,377,581 | A | 6/1945 | Shaffrey | |
| 2,553,479 | A * | 5/1951 | Schmarje et al. | 81/443 |
| 3,952,626 | A | 4/1976 | Townsend | |
| 4,318,316 | A * | 3/1982 | Guilliams | 81/426.5 |
| 4,378,187 | A | 3/1983 | Fullerton | |
| 5,032,048 | A | 7/1991 | Walton | |
| 6,666,639 | B2 | 12/2003 | Van Gent | |
| 6,712,574 | B1 | 3/2004 | Roopnarine | |
| 2005/0238460 | A1 | 10/2005 | Li | |

FOREIGN PATENT DOCUMENTS

| | | | |
|---|---|---|---|
| FR | 2650351 | A1 | 2/1991 |

* cited by examiner

*Primary Examiner*—D. Meislin
(74) *Attorney, Agent, or Firm*—Jeffrey Weiss; Harry M. Weiss; Weiss & Moy, P.C.

(57) ABSTRACT

A grasping device comprises a grasping member springably connected to a handle member. When the grasping member is withdrawn from the handle member, plier arms on the grasping member open so that an object to be grasped may be positioned therebetween. When the grasping member is permitted to be pulled by the spring back into the handle member, the plier arms close about the object, grasping it securely.

4 Claims, 2 Drawing Sheets

BOLT GRASPING DEVICE

FIELD OF THE INVENTION

The present invention relates to grasping devices and, more particularly, to a locking type of grasping device for use with bolt shafts.

BACKGROUND OF THE INVENTION

Various kinds of grasping devices are known for a variety of uses. Examples include regular slip-joint pliers, which are appropriate for general use around the house or on small projects; thin jaw slip-joint pliers, which are more narrow than regular slip-joint but more narrow and can be used to fit into hard to reach areas; multiple slip-joint pliers, which have a plurality of different adjustment settings; crimper-stripper pliers, which may be used to crimp solderless connectors, strip wire, or cut, hold and bend wire; needle-nose or long-nose pliers, which feature a pointed nose for reaching spots that do not have much space; thin or bent-nose pliers, where the nose is bent at an 80-degree angle to reach around specific objects; fence pliers, which are designed to pull and cut out staples from fencing; and locking pliers, which are adjustable, vise-locking pliers that can be locked on to a workplace so you have both hands free.

A need exists for a type of grasping device that is especially suited for grasping the shaft of a threaded bolt, in a locking type of manner wherein the jaws may be readily and secured placed into position over a shaft and then locked in position thereon. The present invention satisfies these needs and provides other, related, advantages.

SUMMARY OF THE INVENTION

In accordance with an embodiment of the present invention, a bolt grasping device is disclosed. The device comprises, in combination: a handle member; and a grasping member springably coupled to the handle member; wherein the grasping member comprises a first plier arm having a first plier jaw and a second plier arm having a second plier jaw; wherein a pulling of at least a portion of the grasping member away from the handle member and against a force provided by the spring, permits an increasing of a distance between the first jaw and the second jaw; and wherein a pulling by the spring of at least a portion of the grasping member toward the handle member permits a decreasing of the distance between the first jaw and the second jaw.

In accordance with another embodiment of the present invention, a bolt grasping device is disclosed. The device comprises, in combination: a top plate; a bottom plate; a plurality of pins coupling the top plate to the bottom plate; an interior plate interposed between the top plate and the bottom plate; a spring coupling the interior plate to one of the plurality of pins; a first plier arm having a first jaw; wherein the first plier arm is pivotably coupled to the interior plate; and a second plier arm having a second jaw; wherein the second plier arm is pivotably coupled to the interior plate; wherein a pulling of at least a portion of the interior plate out of a space between the top plate and the bottom plate, against a force provided by the spring, permits an increasing of a distance between the first jaw and the second jaw; and wherein a pulling by the spring of at least a portion of the interior plate into the space between the top plate and the bottom plate permits a decreasing of the distance between the first jaw and the second jaw.

In accordance with a further embodiment of the present invention, a bolt grasping device is disclosed. The device comprises, in combination: a top plate; a bottom plate; a plurality of pins coupling the top plate to the bottom plate; an interior plate interposed between the top plate and the bottom plate; wherein the interior plate further comprises an interior channel which is positioned about one of the plurality of pins; a spring coupling the interior plate to one of the plurality of pins; a first plier arm having a first jaw; wherein the first plier arm is pivotably coupled to the interior plate; and a second plier arm having a second jaw; wherein the second plier arm is pivotably coupled to the interior plate; wherein the first and second jaws are threaded in a manner intended to permit them to substantially mate with threading on a surface of a bolt; wherein a pulling of at least a portion of the interior plate out of a space between the top plate and the bottom plate, against a force provided by the spring, permits an increasing of a distance between the first jaw and the second jaw; and wherein a pulling by the spring of at least a portion of the interior plate into the space between the top plate and the bottom plate permits a decreasing of the distance between the first jaw and the second jaw.

DETAILED DESCRIPTION OF THE PREFERRED EMBODIMENTS

Figure 1:
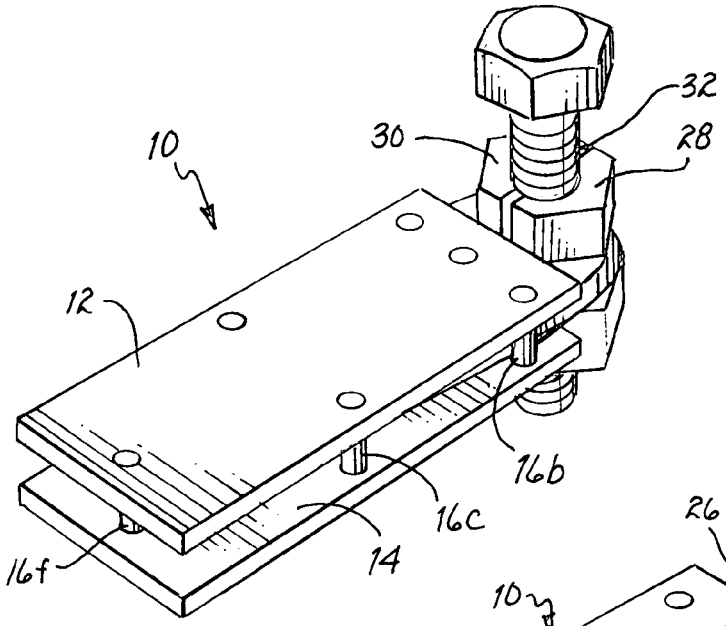
FIG. 1 is a perspective view of a bolt grasping device consistent with an embodiment of the present invention, in a closed position about the shaft of a bolt.

Referring to FIGS. 1-5, an embodiment of a bolt grasping device 10 ("device 10") consistent with an embodiment of the present invention is shown. The main components of the device 10, in this embodiment, include a top plate 12, a bottom plate 14, a plurality of pins 16 that couple the top plate 12 to the bottom plate 14 (and that may perform other functions as herein described).

Interposed between the top plate 12 and bottom plate 14 is an interior plate 18. The interior plate 18 is positioned between pins 16*a*, 16*b*, 16*c* and 16*d*. See FIGS. 3, 5. Preferably, the interior plate 18 includes an interior channel 20, which is positioned about pin 16*e*. In this configuration, and as hereinafter described in greater detail, the interior plate 18 is capable of controlled forward and backward reciprocal movement, relative to top plate 12 and bottom plate 14.

Figure 3:
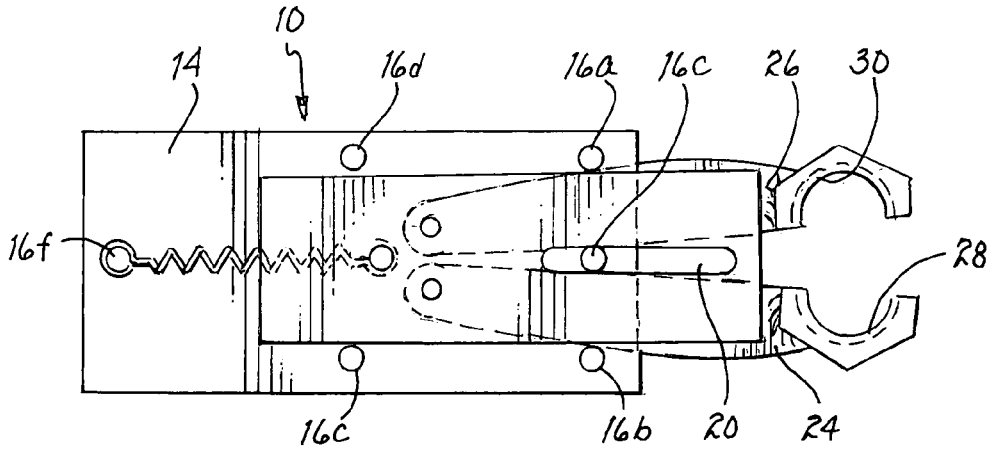
FIG. 3 is a top view of the device of FIG. 1 in an open position, shown with a top plate removed.
Figure 4:
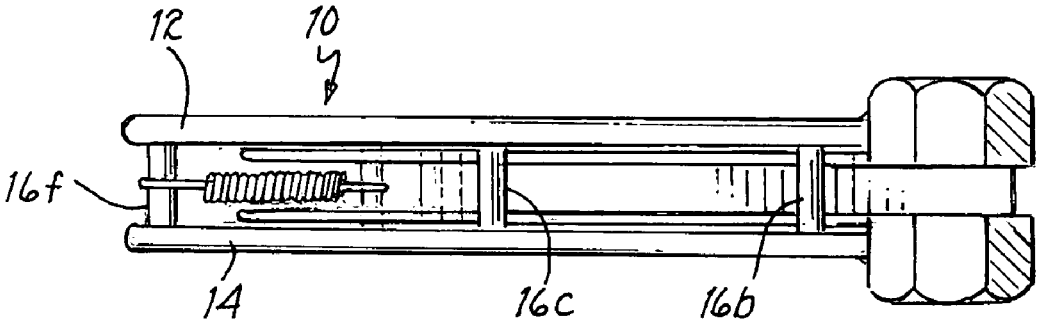
FIG. 4 is a side view of the device of FIG. 1.
Figure 5:
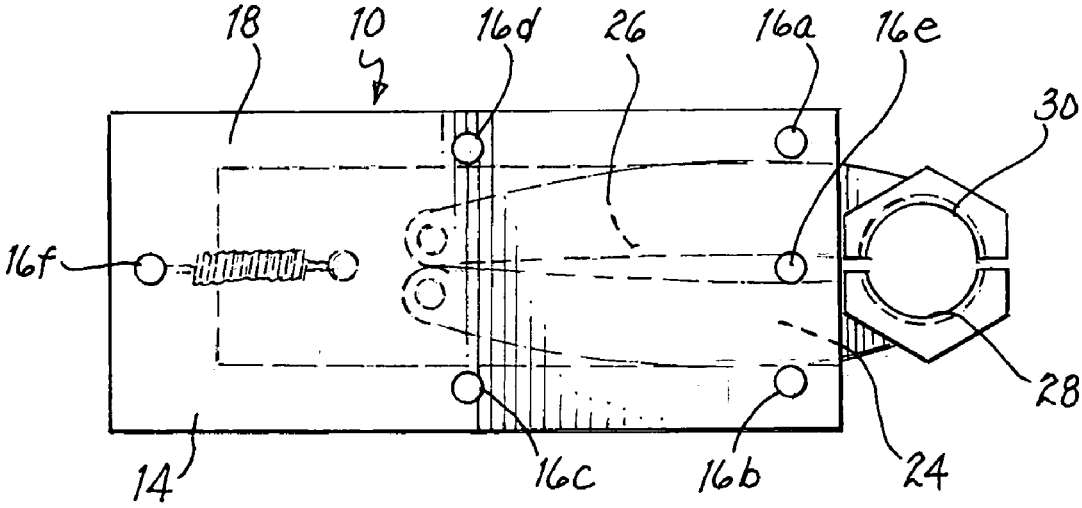
FIG. 5 is a top view of the device of FIG. 1 in a closed position, shown with a top plate removed.

Referring more specifically to FIGS. 3-5, it can be seen that, in this embodiment, a spring 22 is coupled at a first end to pin 16*f*, and at a second end to the interior plate 18. This causes a pulling force to be generated on the interior plate 18, in the direction of pulling the interior plate 18 into the space between the top plate 12 and bottom plate 14.

First plier arm 24 and second plier arm 26 are, in this embodiment, pivotably coupled to the interior plate 18. See, e.g., FIGS. 3, 5. The plier arms 24 and 26 have a placement on the interior plate 18 and an external configuration that causes them to contact pins 16*a* and 16*b* when the interior plate 18 is pulled into the space between top plates 12 and 14, which causes their corresponding jaws 28 and 30 to be pulled toward each other.

Figure 2:
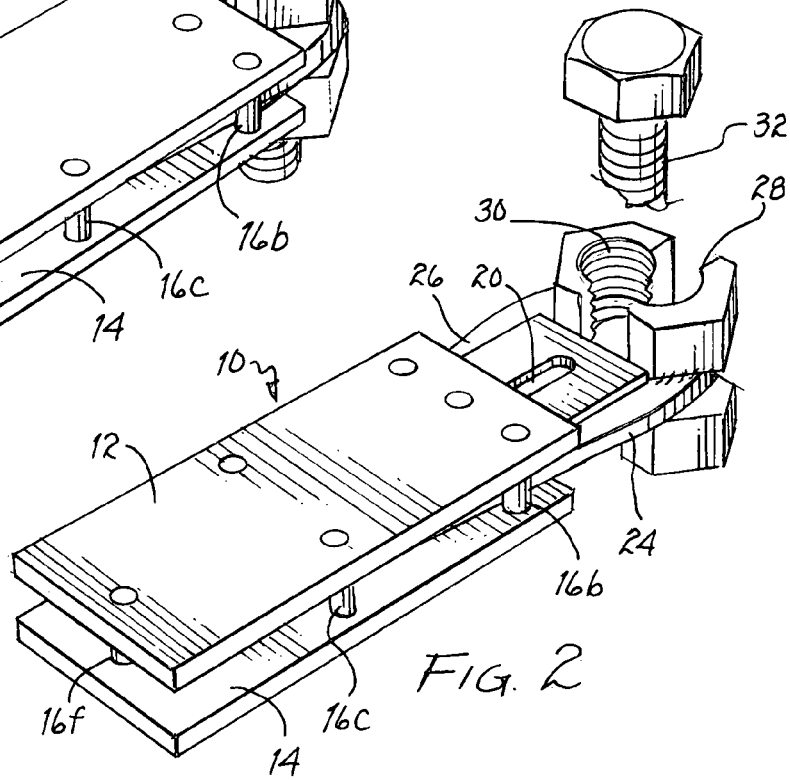
FIG. 2 is a is a perspective view of a bolt grasping device consistent with an embodiment of the present invention, in an open position proximate the shaft of a bolt.

As best seen in FIG. 2, in one embodiment, the jaws 28 and 30 are threaded in the manner of a bolt shaft 32. This configuration is intended to cause a more secure gripping between the jaws 28 and 30, on the one hand, and the bolt shaft 32. The threading is also intended to reduce harm to the threads on the bolt shaft 32, during the gripping thereof.

The combination of the top plate 12 and bottom plate 14 may be referred to as the "handle member." The combination of the interior plate 18 and the plier arms 24 and 26 (and corresponding jaws 28 and 30) may be referred to as the "grasping member."

STATEMENT OF OPERATION

To utilize the device 10 to grasp a bolt shaft 32, the user will first pull the interior plate 18 sufficiently out of the space between the top plate 12 and bottom plate 14, so as to permit a sufficient opening of the space between jaws 28 and 30 to fit about the bolt shaft 32. When the opening is sufficient large, the jaws 28 and 30 will be positioned around the bolt shaft 32. The interior plate 18 may then be released, permitting it to be pulled by the spring 22 in the direction of pin 16*f*. As this occurs, the plier arms 24 and 26 contact pins 16*a* and 16*b*, which causes jaws 28 and 30 to move toward each other, until they are grasping bolt shaft 32. The user may then grasp the device 10 and turn it in the desired direction.

While the invention has been particularly shown and described with reference to the preferred embodiments thereof, it will be understood by those skilled in the art that the foregoing and other changes in form and details may be made therein without departing from the spirit and scope of the invention. For example, it may be desired to provide a more ergonomic and/or grippable handle member, which may for example consist of providing a casing about all or some portion of top plate 12 and bottom plate 14, or which may be configured in a different way. In addition, it should be noted that there may be myriad other configurations, whereby a grasping member may be springably coupled to a handle member, wherein the withdrawal of the grasping member from the handle member causes an opening of the plier arms, and an insertion of the grasping member into the handle member causes a closing of the plier arms about a bolt shaft. Such other configurations would be considered to be consistent with the scope of the present invention.

Finally, while there has been discussion regarding the grasping of a bolt shaft, it should be noted that the device of the present invention could be utilized to grasp a bolt head or other object.

I claim:

1. A bolt grasping device comprising, in combination:

a top plate;

a bottom plate;

a plurality of pins coupling the top plate to the bottom plate;

an interior plate interposed between the top plate and the bottom plate;

a spring coupling the interior plate to one of the plurality of pins;

a first plier arm having a first jaw;

wherein the first plier arm is pivotably coupled to the interior plate; and a second plier arm having a second jaw;

wherein the second plier arm is pivotably coupled to the interior plate;

wherein a pulling of at least a portion of the interior plate out of a space between the top plate and the bottom plate, against a force provided by the spring, permits an increasing of a distance between the first jaw and the second jaw; and wherein a pulling by the spring of at least a portion of the interior plate into the space between the top plate and the bottom plate permits a decreasing of the distance between the first jaw and the second jaw.

2. The device of claim 1 wherein the interior plate further comprises an interior channel which is positioned about one of the plurality of pins.

3. The device of claim 1 wherein the first and second jaws are threaded in a manner intended to permit them to substantially mate with threading on a surface of a bolt.

4. A bolt grasping device comprising, in combination:

a top plate;

a bottom plate;

a plurality of pins coupling the top plate to the bottom plate;

an interior plate interposed between the top plate and the bottom plate;

wherein the interior plate further comprises an interior channel which is positioned about one of the plurality of pins;

a spring coupling the interior plate to one of the plurality of pins;

a first plier arm having a first jaw;

wherein the first plier arm is pivotably coupled to the interior plate; and a second plier arm having a second jaw;

wherein the second plier arm is pivotably coupled to the interior plate;

wherein the first and second jaws are threaded in a manner intended to permit them to substantially mate with threading on a surface of a bolt;

wherein a pulling of at least a portion of the interior plate out of a space between the top plate and the bottom plate, against a force provided by the spring, permits an increasing of a distance between the first jaw and the second jaw; and wherein a pulling by the spring of at least a portion of the interior plate into the space between the top plate and the bottom plate permits a decreasing of the distance between the first jaw and the second jaw.

* * * * *